US008011107B2

(12) United States Patent
Miyagawa et al.

(10) Patent No.: US 8,011,107 B2
(45) Date of Patent: Sep. 6, 2011

(54) JIG FOR SELECTING VALVE PART NUMBER OR JOINT PART NUMBER

(75) Inventors: Hideyuki Miyagawa, Osaka (JP); Takayasu Nakahama, Osaka (JP); Syuichi Kuriyama, Osaka (JP)

(73) Assignee: Kabushiki Kaisha Fujikin, Osaka (JP)

( * ) Notice: Subject to any disclaimer, the term of this patent is extended or adjusted under 35 U.S.C. 154(b) by 221 days.

(21) Appl. No.: 12/516,210

(22) PCT Filed: Apr. 17, 2008

(86) PCT No.: PCT/JP2008/057524

§ 371 (c)(1),
(2), (4) Date: May 26, 2009

(87) PCT Pub. No.: WO2009/004850

PCT Pub. Date: Jan. 8, 2009

(65) Prior Publication Data

US 2010/0050928 A1 Mar. 4, 2010

(30) Foreign Application Priority Data

Jun. 29, 2007 (JP) ..... 2007 173099

(51) Int. Cl.
*G06C 3/00* (2006.01)
*G09F 11/00* (2006.01)

(52) U.S. Cl. ..... 33/321; 33/324

(58) Field of Classification Search ..... 116/321, 116/322, 323, 324; 40/490, 491; 235/70 R, 235/70 A See application file for complete search history.

(56) References Cited

U.S. PATENT DOCUMENTS

| | | | | | |
|---|---|---|---|---|---|
| 1,672,389 | A | * | 6/1928 | Mahon | 40/491 |
| 2,288,728 | A | * | 7/1942 | Meredith | 40/491 |
| 2,530,423 | A | * | 11/1950 | Carson | 434/195 |
| 4,272,674 | A | * | 6/1981 | Takahashi et al. | 235/69 |
| 4,568,822 | A | * | 2/1986 | Betzko | 235/78 R |
| 5,136,965 | A | * | 8/1992 | Tamburro, Jr. | 116/321 |
| 5,253,441 | A | * | 10/1993 | Rachiele et al. | 40/488 |

FOREIGN PATENT DOCUMENTS

| | | | |
|---|---|---|---|
| FR | 2604016 | A1 * | 3/1988 |
| FR | 2733899 | | 11/1996 |
| JP | S51-45289 | | 10/1977 |
| JP | 2001521257 | | 11/2001 |
| JP | 2005164550 | | 6/2005 |
| JP | 2007304701 | | 11/2007 |
| KR | 20010031290 | | 4/2001 |
| KR | 724275 | | 6/2007 |
| WO | WO 2009004850 | A1 * | 1/2009 |

* cited by examiner

*Primary Examiner* — R. A. Smith
(74) *Attorney, Agent, or Firm* — Mark Friedman

(57) ABSTRACT

A jig for selecting a valve part number or a joint part number representing respective selected conditions required for selecting a valve or a joint comprising: a substantially rectangular base plate defining an inner space, and several sliding gauges laterally arranged in the inner space to slide in a longitudinal direction of the base plate, each of the sliding gauges comprising a condition description area including several conditions thereon from which the selected condition is determined, and a symbol description area including several symbols thereon, both the conditions and the symbols arranged in the sliding direction, several condition selecting windows laterally arranged, each of the condition selecting window being configured to expose one of the selected conditions, several symbol selecting windows laterally arranged, each of the symbol selecting window being configured to expose one of the selected symbols.

3 Claims, 10 Drawing Sheets

[Fig. 1]
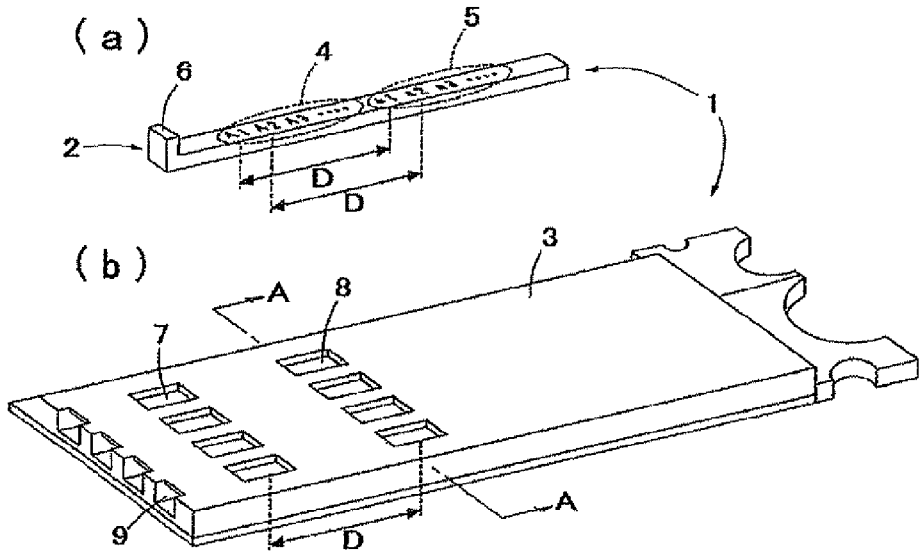

[Fig.2]
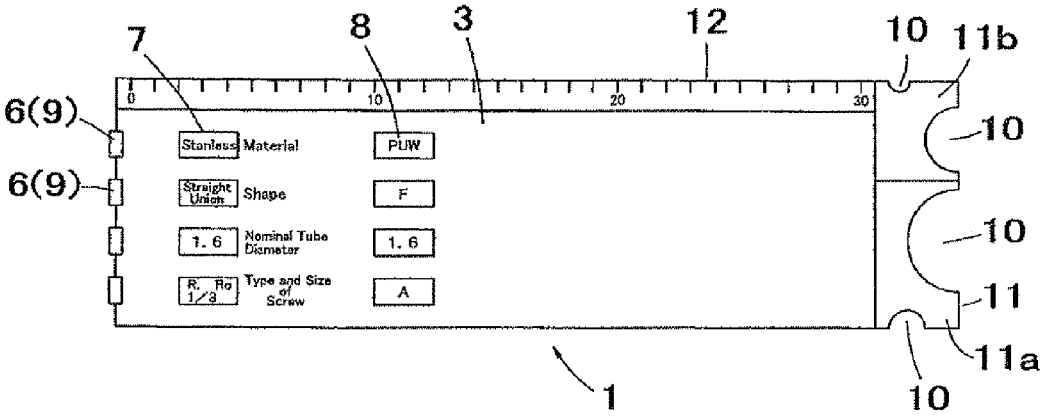

[Fig.3]
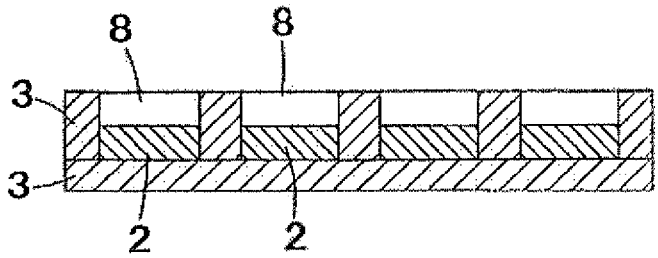
[Fig.4]
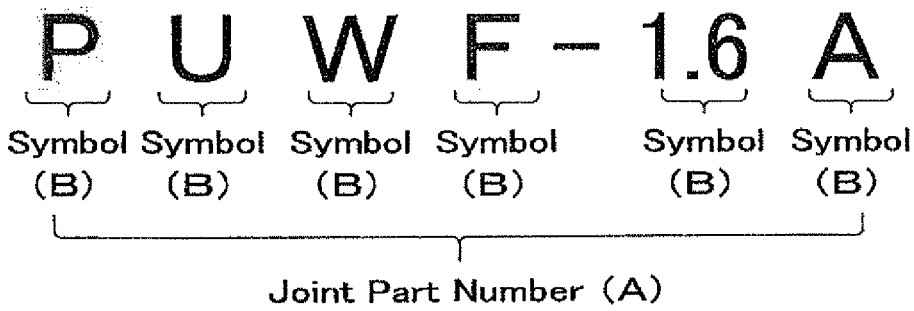

[Fig.5]
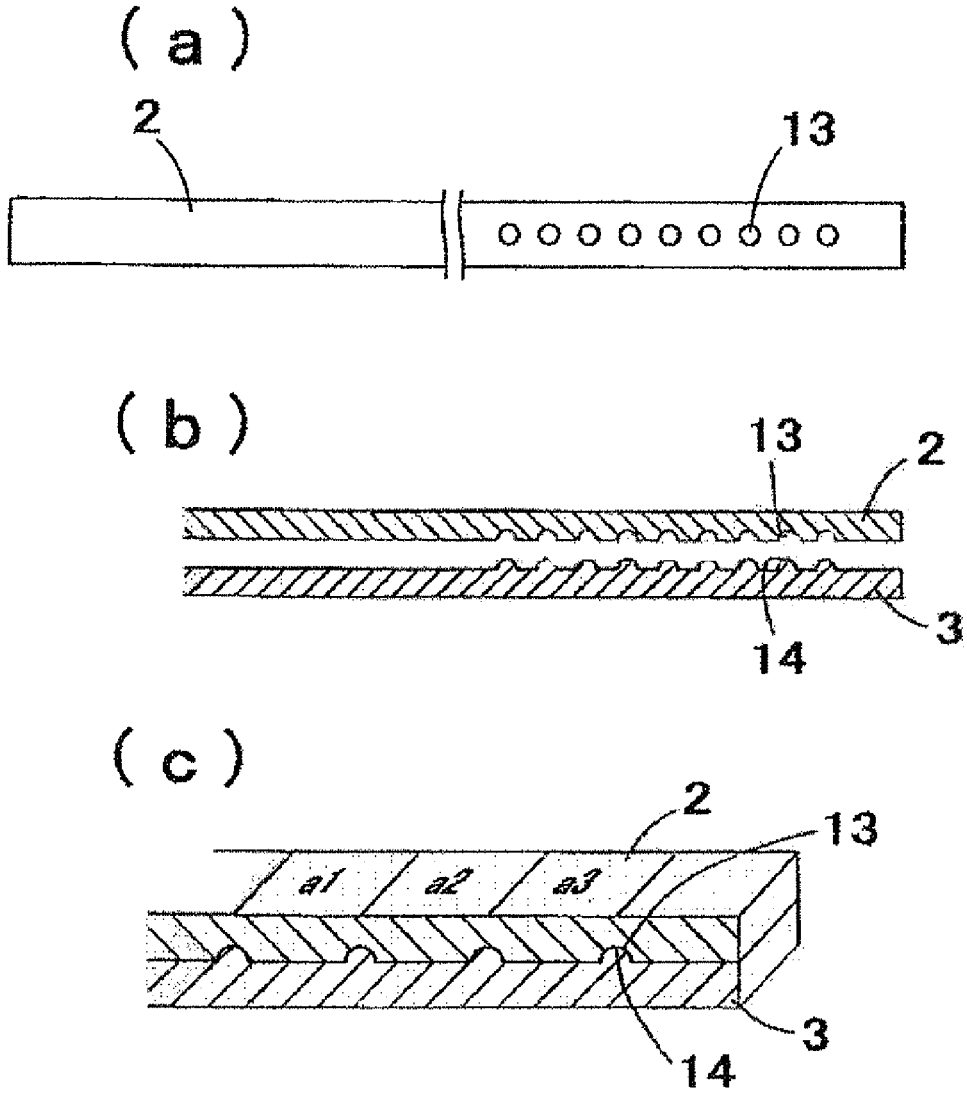

[Fig.6]
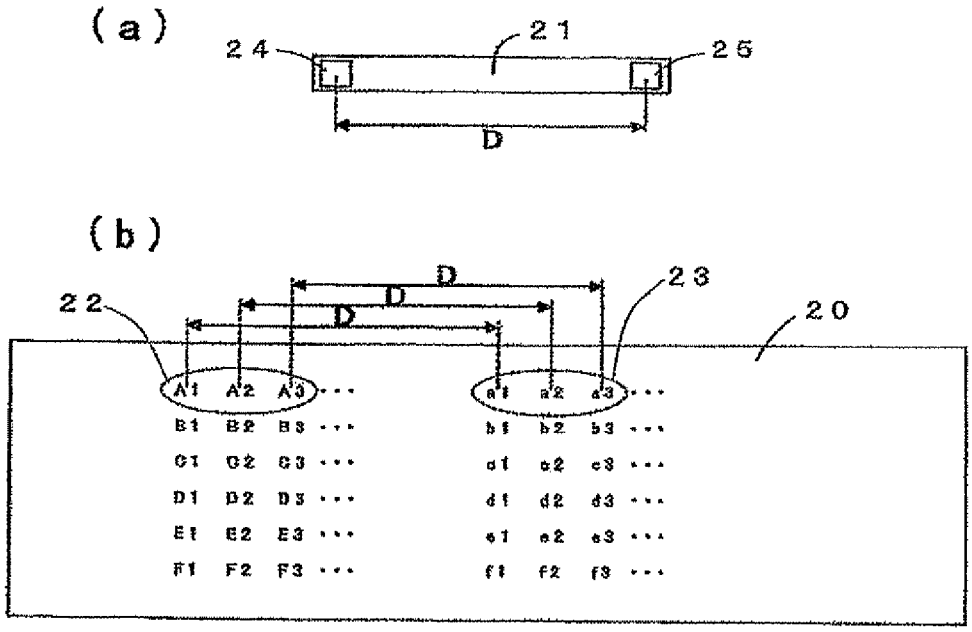
Prior Art

[Fig.7]
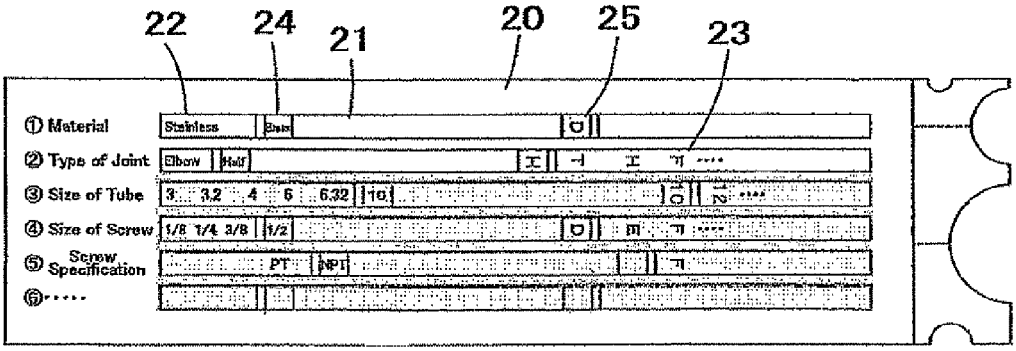
Prior Art

[Fig.8]
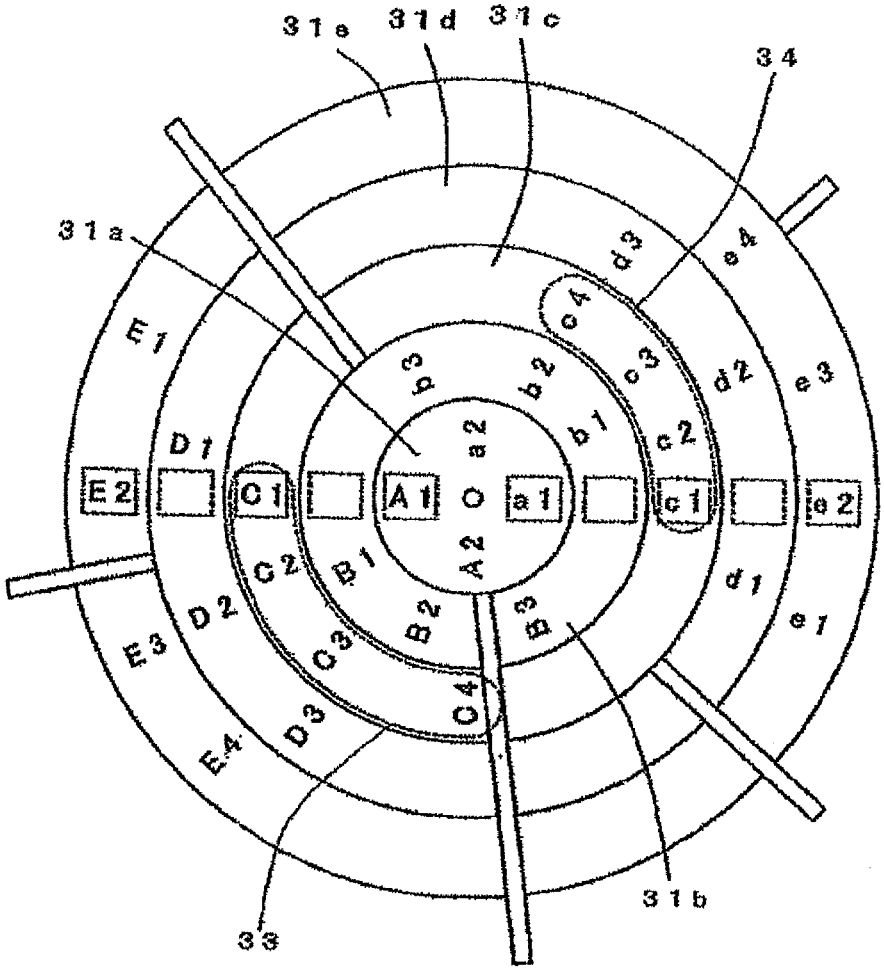
Prior Art

[Fig.9]
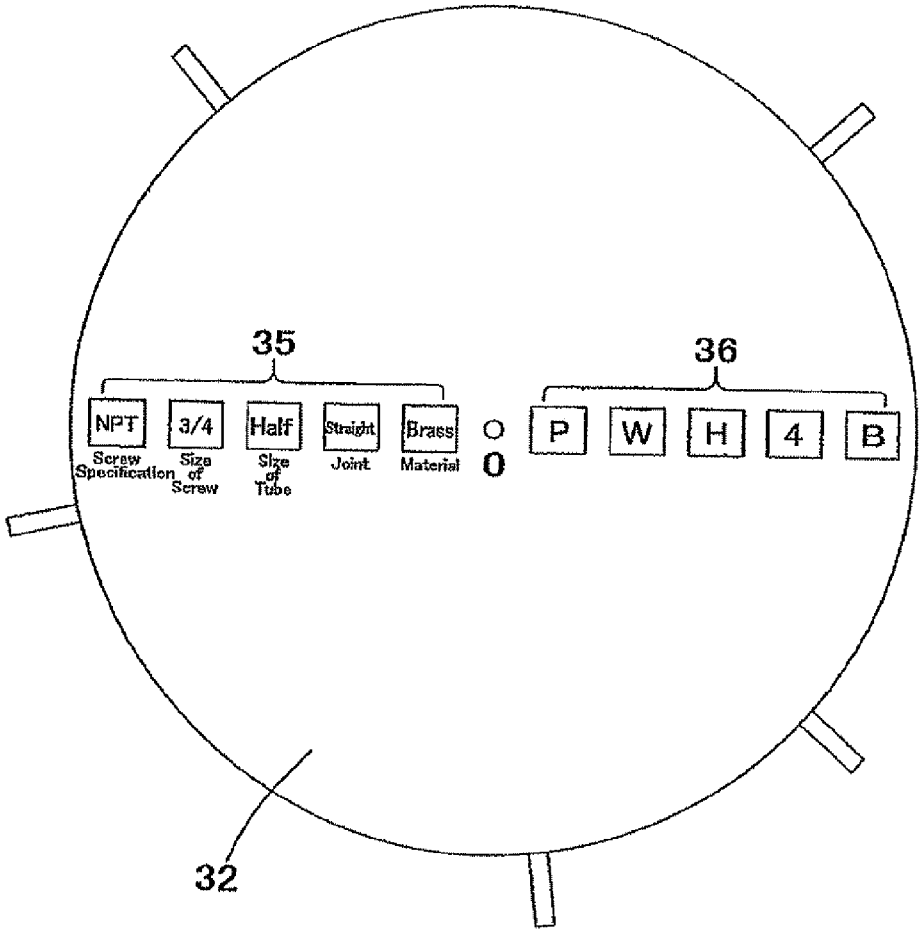
Prior Art

[Fig.10]
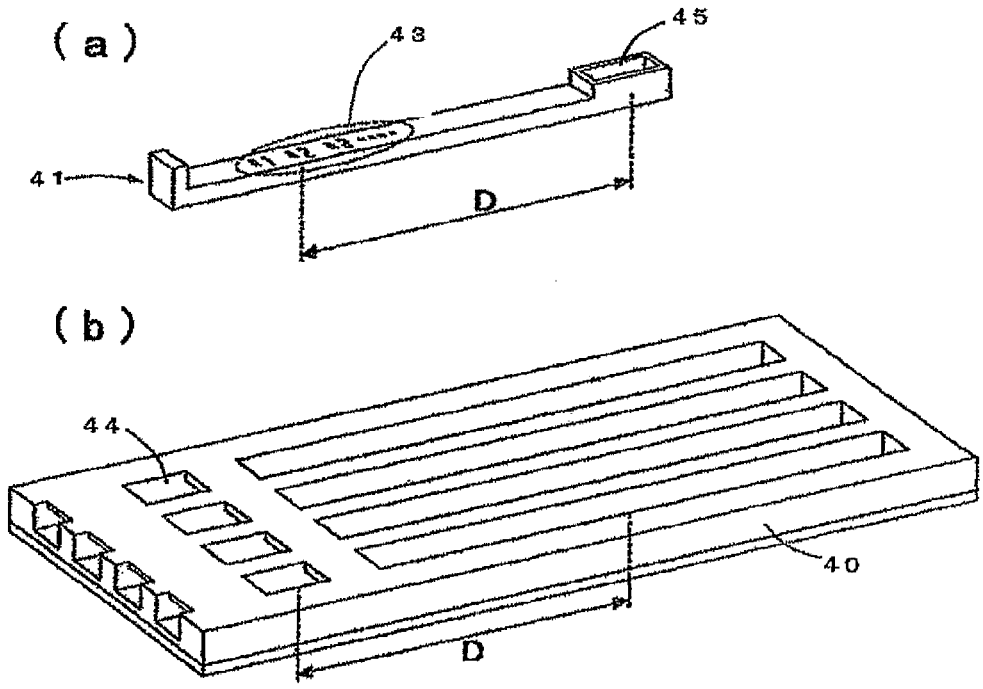
Prior Art

[Fig.11]
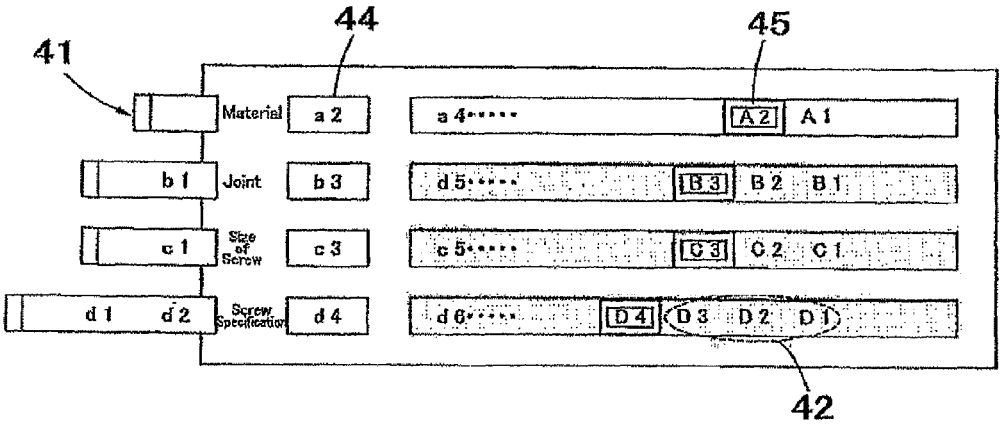
Prior Art

JIG FOR SELECTING VALVE PART NUMBER OR JOINT PART NUMBER

CROSS REFERENCE TO RELATED APPLICATIONS

This application is International Application No. PCT/JP2008/057524, filed on Apr. 17, 2008, which claims priority of Japanese Patent Application No. 2007-173099, filed on Jun. 29, 2007, the entire content and disclosure of the preceding applications are incorporated by reference into this application.

BACKGROUND OF THE INVENTION

1. Field of the Invention

This invention relates to a jig for selecting a valve part number or a joint part number which is able to accurately and quickly select a desired valve or a joint for usage of a valve or a joint.

2. Description of the Related Art

There are numerous kinds of valve or joint, for example, a valve for opening and closing a space (pipe) in which gas or water flows or a valve having a function of controlling the flow of gas or water, or a joint for connecting tubes. This wide variety of valve or joint enables a user to select the valve or joint most appropriately and effectively. When ordering a desired valve or joint from a valve or joint manufacturer, a user needs to order with using a valve part number or a joint part number attached thereto. However, it was difficult for a user to select these valve or joint part numbers effectively. For example, after a user spent a lot of effort to search a desired valve part number in a huge volume of catalog for the selection of the desired valve part number, and then a user could select the desired valve. For this reason, time and effort are required for selecting a valve part number after deciding the valve for use. Further, it would happen to a user to order a valve or a joint with wrong part number.

To solve these problems, a jig for quickly and efficiently selecting a valve part number or a joint part number has been required in a field.

In view of the above-described circumstances, the applicant of the invention discloses a jig in Japanese Patent Publication No. 2005-164550 described below for selecting a part number of a valve or joint.

The technique disclosed in Japanese Patent Publication No. 2005-164550 provides a jig for selecting a valve or joint part number represented by a combination of symbols. Each symbol corresponds to a selected condition from a plurality of conditions required for a selection of the valve or joint. Examples 1 to 4 below are shown in Japanese Patent Publication No. 2005-164550.

EXAMPLE 1

As shown in FIGS. 6 and 7, Example 1 comprises a base body (20) and a sliding gauge (21) which slides along with a surface of the base body (20).

The base body (20) includes a condition description area (22) on which a plurality of conditions are described in the sliding direction of the sliding gauge (21), and a symbol description area (23) on which a plurality of symbols are described in the sliding direction. A single condition and its corresponding single symbol are described at a constant distance in a sliding direction at the both description area (22) and (23).

The sliding gauge (21) is provided with a condition selecting window (24) opening on the condition description area (22) to display a single condition and a symbol selecting window (25) opening on the symbol description area (23) to display a single symbol. The symbol selecting window (25) is provided at a constant distance from the condition selecting window (24) in a sliding direction.

EXAMPLE 2

As shown in FIGS. 8 and 9, Example 2 has substantially circle base bodies (31*a*) to (31*e*) and a substantially circle sliding gauge (32). The sliding gauge (32) is concentrically placed with the base bodies (31*a*) to (31*e*) and slides along with circumferential directions.

For more details, as shown in FIG. 8, the Example 2 comprises a plurality of the base bodies (31*a*) to (31*e*) in various diameters. The base bodies (31) are stacked from the largest base body (31*a*) to the smallest base body (31*e*). Each base body (31*a*) to (31*e*) includes a condition description area (33) and a symbol description area (34).

As shown in FIG. 9, the sliding gauge (32) having the same shape as the largest base body (31*e*) has a plurality of condition selecting windows (35) and a plurality of symbol selecting windows (36), which are aligned along a diameter of the sliding gauge (52).

EXAMPLE 3

As shown in FIGS. 10 and 11, Example 3 comprises a base body (40) and a sliding gauge (41) which slides along with a surface of the base body (40). The base body (40) includes a condition description area (42) on which a plurality of conditions are described in a sliding direction of the sliding gauge. The sliding gauge (41) includes a symbol description area (43) on which a plurality of symbols are described in the sliding direction. The base body (40) also includes a symbol selecting window (44) provided with a constant distance from the condition description area (42). The symbol selecting window (44) opens on the symbol description area (43) to display a single symbol. The sliding gauge (41) includes a condition selecting window (45) provided at a constant distance from the symbol description area (43). The condition selecting window (45) opens on the condition description area (42) to display a single condition.

EXAMPLE 4

Example 4 shows the modified version of Example 3 in which the condition description area (42) is replaced with the symbol description area (43). The condition selecting window (45) opens on the base body (40) and the symbol selecting window (44) opens on the sliding gauge (41).

However, there were many problems with a jig for selecting a valve part number or a joint part number disclosed in Japanese Patent Publication No. 2005-164550.

In Example 1, as shown in FIG. 7, misalignment among the selected conditions or among the symbols resulting from simultaneous movement between the plurality of the condition selecting window (24) and the plurality of the symbol selecting window (25) makes it difficult to recognize a selected condition or a selected part number in a moment, and may further cause a misreading for them. The same problem is also caused in Example 3 and 4.

Also the example shown in FIG. 7 does not only expose desired conditions and desired symbols from the (24) and the (25) but also unrelated conditions and symbols, which also result in a potential misleading. The same problem is also caused in Example 3 and 4.

In addition, revision in the valve or joint part number, which often occurs, requires replacement of the whole base body (20) of Example 1 shown in FIG. 6 on which the condition description area (22) and the symbol description area (23) is provided. Thus, it is troublesome to change the part number.

Further, as shown in FIG. 7, it is inconvenient to carry the base body with inserting the sliding gauge (21) therein because the sliding gauge (21) falls if the base body (20) is upside-down.

There is also a problem of misreading caused by displacement of the sliding gauge (21) before reading. This is because Example 1 has no mechanism to stop the sliding gauge (21) at the desired location when the sliding gauge (21) slides along with the base body (20).

In addition, as shown in FIG. 8, when using the circular base body (31) and sliding gauge (32) as in Example 2, the stacking configuration of the plurality of the base bodies (31*a*) to (31*e*) with various sizes prevents neither compact nor simple structure.

Also, area for describing conditions and symbols are inconsistent through the base bodies (31*a*) to (31*e*). Thus, the smallest base body (31*a*) is too narrow to describe the conditions and the symbols, on the other hand too much excessive space remains on the largest base body (31*e*).

Considering the above-described problems, one object of the present invention is to provide a jig for accurately and quickly selecting a part number of the desired valve or joint. The jig enables to accurately and quickly select the desired valve or the joint with accuracy and with speed without misreading of the part number of the desired valve or the joint. The present invention also provides an adaptable jig for selecting a part number of the desired valve or joint for revision in the part number. The present invention also provides a compact and simple jig, which is convenient for carriage, for selecting a part number of the desired valve or joint, with keeping an enough space for describing a plurality of the conditions and symbols without excessive space.

MEANS FOR SOLVING THE PROBLEM

To achieve the above objects, one embodiment of the present invention comprises a jig for selecting a valve part number or a joint part number represented by a combination of selected symbols representing respective selected conditions required for selecting a valve or a joint comprising: a substantially rectangular base plate defining an inner space, and a plurality of linear sliding gauge laterally arranged in the inner space to slide in a longitudinal direction of the base plate, the sliding gauge comprising a condition description area including a plurality of conditions from which the selected condition is determined, and a symbol description area including a plurality of symbols thereon, and a symbol description area including a plurality of symbols thereon, both the conditions and the symbols arranged in a sliding direction of the sliding gauge, a plurality of condition selecting windows laterally arranged on a top of the base plate, each condition selecting window configured to expose one of the selected conditions, a plurality of symbol selecting windows laterally arranged on the top of the base plate longitudinally apart from the condition selecting windows, respectively, each symbol selecting window configured to one of the selected symbols, wherein a distance between both windows is equivalent to a fixed distance between each of the symbols in the symbol description area and its corresponding condition in the condition description area.

Another embodiment of the present invention comprises the jig for selecting the part number of the valve or the joint in claim 1 further comprising a plurality of concaves on a bottom of the sliding gauge; and a plurality of protrusions on an inner surface of the base plate contacting to the bottom, the protrusion configured to engage with the concave, wherein a distance between the adjacent conditions and between the adjacent symbols described on the sliding gauge are equal to a distance between the adjacent concaves and between adjacent protrusions.

Yet another embodiment of the present invention comprises the jig for selecting the part number of the valve or the joint in claim 2, wherein the concaves exist only in a longitudinal half area of the sliding gauge, and the protrusions exist only in a longitudinal half area of the base plate.

In one embodiment of the present invention, due to the above described configuration such as a lateral alignments among the condition selecting windows and among the symbol selecting windows provide aligned display on certain selected conditions and its corresponding symbols, which leads to a quick and accurate understanding on a selected condition and a parts number without minimizing potential misreading because of a straight reading line.

A user may visibly access only the desired selected conditions and symbols through the condition selecting windows and the symbol selecting windows without unrelated conditions and symbols when he see an upper surface of the base body, so that possibility of misreading is minimized.

Further, each of the sliding gauges comprises the condition description area and the symbol description area. Thus, the sliding gauge relating to a change in a condition or a revision in a part number of a valve or a joint is selected from the plurality of the sliding gauges as one to be replaced when changing a part of the condition or the symbol of the valve or the joint, thereby achieving easy replacement.

Also, the base body is formed in a one rectangular plate and a plurality of the sliding gauges is contained within the base body. Thus, the jig becomes compact and small enough for easy carriage and usage.

Also, the straight sliding gauge is wide enough to put the plurality of conditions and the symbols in the sliding direction without leaving excessive space.

Another embodiment of the present invention comprises a plurality of concaves at the back side of the sliding gauge. The base body comprises a plurality of protrusions engaging with the concave on a surface contacting with the back side of the sliding gauge. The distance between adjacent conditions and the distance between adjacent symbols are equal to the distance between adjacent concaves and the distance between adjacent protrusions. This causes a big friction between the sliding gauge and the base body at every condition or symbol of the sliding gauge when the sliding gauge is slid. For this reason, the sliding gauge pauses sliding at every condition or symbol. Thus, an offset position of the sliding gauge would be avoided before the condition and symbol displayed from the window can be read by a user so that the possibility of misreading of the condition or symbol can be decreased.

Yet in another embodiment of the present invention, the concave is formed on only a half area of the sliding gauge in the sliding direction, and the protrusion is formed on only a half area of the base body in the longitudinal direction. This avoids excessive friction during sliding operation, restraining the sliding of the sliding gauge. Thus, the sliding gauge slides at an appropriate speed for a user's operation.

Also, the sliding gauge can be surely prevented from slipping out of the base body when the concave and the protrusion are provided in a vicinity of an inlet of the base body for the sliding gauge inserted therein.

Further, if the concave and the protrusion are provided on the other side of the inlet of the base plate, the sliding gauge can be easily stopped at the desired condition or symbol to expose the condition description area and the symbol description area on the tip of the sliding gauge through the condition selecting window and the symbol selecting window when the sliding gauge is almost maximally pulled.

BRIEF DESCRIPTION OF THE DRAWINGS

Hereinafter, detailed description of preferred embodiment of the present invention will be described.

FIG. 1 is a perspective view showing a base body and a sliding gauge of a jig for selecting a joint part number of the present invention FIG. 2 is a top view of the present invention showing a plurality of sliding gauges are contained within a base body.

FIG. 3 is an A-A cross-sectional view of FIG. 1 showing a positional relation of a base body, a sliding gauge and a condition selecting window.

FIG. 4 shows a part number comprising the combination of a symbol corresponding to each of the conditions displayed at a symbol selecting window.

FIG. 5 shows a slide controlling means provided on a back side of the sliding gauge and a base body of the present invention. FIG. 5(*a*) shows a back side of the sliding gauge, FIG. 5(*b*) is a cross sectional view of the sliding gauge and the base body, and FIG. 5(*c*) is a sectional view showing a protrusion of the base body engaging with a concave of the sliding gauge.

FIG. 6 is a top view of Example 1 in the prior art. FIG. 6(*a*) shows a sliding gauge and FIG. 6(*b*) shows a base body.

FIG. 7 is a top view of Example 1 of the prior art.

FIG. 8 is a top view of a base body of the Example 2 of the prior art.

FIG. 9 is a top view of Example 2 of the prior art.

FIG. 10 is a perspective view of Example 2 of the prior art. FIG. 10(*a*) shows a sliding gauge, and FIG. 10(*b*) shows a base body.

FIG. 11 is a top view of Example 3 of the prior art.

DETAILED DESCRIPTIONS

In one embodiment of the present invention, a selection of a joint part number is described, however, the present invention is also acceptable for a selection of a valve part number.

Note that the term "a joint part number" means "a combination of a number or a symbol for identifying a joint" which is defined for a joint by those skilled in the art such as a joint manufacturer.

Further, the term "condition item" means a condition which is defined by those skilled in the art when setting the joint part number. For example, as shown in FIG. 2, there are 4 condition items such as "material", "shape", "nominal tube diameter" and "type and size of screw". These items are properly set depending on an application or a type of the joint.

The term "condition(s)" used herein means the conditions from which a user determines selected conditions. The "condition item" is consisted of a plurality of "conditions". For example, the "material", which is one of the "condition items", includes "stainless steel", "brass", "aluminum" and etc.

"Joint part number" described above includes a plurality of "symbols" represented with Hiragana (Japanese character), Katakana (Japanese character), alphabets, numerals and so on. A single "symbol" corresponds to a single "condition". For example, "PDW" as the "symbol" is assigned to the "brass" as the "condition". Note that a representation set as "symbols" may be properly selected and set by a user, respectively.

The configuration of a jig for selecting a joint part number of the present invention will be explained by referring the drawings.

FIG. 1 is a perspective view of a jig for selecting a joint part number of the present invention in which a sliding gauge is removed from a base body. FIG. 1(*a*) shows a sliding gauge and FIG. 1(*b*) shows a base body.

FIG. 2 is a top view of a jig for selecting a joint part number of the present invention in which a sliding gauge is contained within a base body.

FIG. 3 is an A-A cross-sectional view of FIG. 1 showing a positional relation of a base body, a sliding gauge and a symbol selecting window.

A jig for selecting a joint part number (1) of the present embodiment comprises a sliding gauge (2) and a base body (3).

A shape of the sliding gauge (2) is not limited but corresponds to that of the base body (3) as described later. In the present embodiment, the sliding gauge (2) including a planer top substantially straight. The length of the sliding gauge (2) is set depending on a condition and the number of symbols described thereon. Further, the width of the plurality of the sliding gauge (2) is equal with each other, and is set depending on the number of condition items of the base body (3). For example, when there are 4 conditions, the sliding gauge (2), of which width is substantially equal to a quarter of the base body (3) in width, is wide enough to describing the conditions and symbols.

As shown in FIG. 1(*a*), a left side on the upper surface of the sliding gauge (2) includes a condition description area (4) on which a plurality of the conditions are representationally aligned in a sliding direction of the sliding gauge. A right side on the upper surface of the sliding gauge (2) includes a symbol description area (5) on which a plurality of the symbols are representationally aligned in a sliding direction of the sliding gauge. Each symbol described on the symbol description area (5) corresponds to the each condition described on the condition description area (4).

For example, a symbol (a1) corresponds to and is apart from the condition (A1) by a constant distance (D) in a sliding direction (the right direction in FIG. 1(*a*)). In FIG. 1(*a*), a plurality of the conditions (A1, A2, A3, etc.) correspond to a plurality of the symbols (a1, a2, a3, etc.), respectively. Every symbol is apart from its corresponding condition by the constant direction (D). Thus, both dimensions from (A2) to (a2), and from (A3) to (a3) are also shown as the constant distance (D).

Note that a positional relationship between the condition description area (4) and the symbol description area (5) may be vice versa while the condition description area (4) is located on the left side of the sliding gauge (2) and the symbol description area (5) is located on the right side of the sliding gauge (2) in this embodiment. However, such a location should be corresponded to the location of a condition selecting window (7) and a symbol selecting window (8) on the base body (3) which will be described later.

Also, the left end of the sliding gauge (2) includes an engagement part (6) protruding in a vertical direction. The engagement part (6) is configured to prevent the sliding gauge (2) from being jammed inside of the base body (3) when the sliding gauge (2) slides in the inner space of the base body (2) too much. The engagement part (6) is located on the left of the sliding gauge (2) in the present embodiment, however, the engagement part (6) is located on the right end of the sliding gauge (2) when an inlet (9) is provided on the right of the base body (3), which will be described later.

As shown in FIG. 1(*b*) and FIG. 2, the base body (3) is a substantially plate form. In this embodiment, the base body (3) has a rectangular shape with the predetermined width, and also has an inner space between a top and a bottom thereof.

Base body (3) slidably contains a plurality of the sliding gauge (2) laterally arranged in the inner space. The sliding gauge (2) is provided side by side in the width direction of the base body (3) in order of the symbols which represent a part number of a joint. Providing the sliding gauge (2) in this way, a corresponding part number of a joint will be automatically shown when the condition is set by a user's operation with a plurality of the sliding gauges (2).

The width of the base body (3) is properly set depending on a number of the condition items described above.

The top of the base body (3) includes a plurality of the condition selecting window (7) laterally arranged from one edge to another edge of the base plate (2) with a certain pitch. The number of the condition selecting window (7) is not limited but should correspond to the number of the condition items. In this embodiment, there are 4 condition selecting windows (7) opening on the base body (3). Also, the number of the condition selecting windows (7) is the same as that of the sliding gauges (2) as well as that of inlet (9) of the base body (3) which will be described later.

As shown in FIG. 2, the condition selecting window (7) exists on the condition description area (4) of the sliding gauge (2) sliding in the inner space of the base body (3) so that a single condition can be displayed.

As shown in FIG. 1, a plurality of the symbol selecting windows (8) longitudinally apart from the condition selecting windows (7) by the constant distance (D), respectively are laterally arranged on the top of the base plate (3). The number of the symbol selecting window (8) is not limited but the same as that of the condition selecting window (7) Thus, there are 4 selecting symbol windows (8) opening on the base body (3).

The symbol selecting window (S) exists on the symbol description area (5) of the sliding gauge (2) sliding in the inner space of the base body (3) so that a single symbol can be displayed.

The condition selecting window (7) configured to surround the single condition of the condition description area (4) on the sliding gauge (2), and the symbol selecting window (8) is configured to surround the single symbol of the symbol description area (5) on the sliding gauge (2). That is, the condition and the symbol as large as the whole width of the sliding gauge (2) can be displayed via the condition selecting window (7) and the symbol selecting window (S) when seeing from above because the width of sliding gauge (3) are substantially the same as the width of the condition selecting window (7) and the symbol selecting window (8).

The form of the condition selecting window (7) (see FIG. 3) and the symbol selecting window (8) are not limited as long as they display and show a single condition and a single symbol, respectively.

In this embodiment of the present invention, the condition selecting window (7) is provided near the left end of the base body (3) but the present invention is not limited to this configuration. It may also be applicable to change the location of the condition selecting window (7) and the symbol selecting window (8) and to have the symbol selecting window (8) opening near the left end of the base body (3) However, it should be noted that the location of the condition selecting window (7) and the symbol selecting window (8) should be correspond to that of the condition description area (4) and the symbol description area (5).

The inlets (9) as many as a plurality of the sliding gauges (2) at the left end of the base body (3) are provided. The sliding gauge (2) can be inserted in the inner space of the base body (3) through the inlet (9). A mechanism of the engagement part (6) of the sliding gauge (2) for latching the sliding gauge (2) will be provided at the inlet (9) because the engagement part (6) of the sliding gauge (2) protrudes upwardly from the inlet (9) of the base body (3).

In the embodiment of the present invention, the inlet (9) is provided on the left end of the base body (3) but it is not limited to this configuration. The inlet (9) may be provided on the right end of the base body (3). However, in this case, it should be noted that the engagement part (6) should be provided on the right end of the sliding gauge (2).

Also, the number of the inlets (9) is set as many as that of the sliding gauge (2).

As shown in FIG. 2, 4 semicircular-shaped notches (10) with the same diameter as a predetermined outer diameter of the pipe are provided at a longitudinal end of the base body (3). The Size of the notch (10) is not limited but corresponds to the outer diameter of the pipe which meets Japan Industrial Standards (JIS). The number of the notch (10) is not limited but is properly set, for example, 3 or less, or 5 or more.

The notches (10) may function as a measure for various diameters of pipes.

Also, a member (11) in which the notch (10) is formed may have various thickness. For example, the member (11) including the notches (10) shown in FIG. 2 includes 2 different-thickness portions (11*a*) and (11*b*). The notch (10) can be used as a feeler gauge due to the different-thickness portions (11*a*) and (11*b*). As shown in FIG. 2, 2 kinds of gap can be measured by 2 different-thickness portions.

Also as shown in FIG. 2, a ruler (12) with scale for a measurement of the length is preferably provided along with an end edge extending in the longitudinal direction of the base body (3) to measure a pipe length and so on.

Next, a jig operation for selecting a joint part number (1) will be explained.

The condition items for comprising the joint part number on the sliding gauge (2) may depend on joints. For example, as shown in FIG. 2, the joint part number comprises the condition items including "material", "shape", "nominal tube diameter" and "type and size of screw".

Further, the condition items comprising the joint part number may include: the conditions such as "stainless steel" and "brass" corresponding to the "material" of condition lists; the conditions such as "straight union", "male connector", "bulkhead union" "bulkhead male connector" and so on corresponding to the "shape" of the condition list; the conditions such as "1.6 mm", "3 mm", "3.2 mm" "4 mm" and so on (which are properly set according to JIS) corresponding to the "nominal tube diameter" of the condition list; and the conditions such as "none", "R, Rc⅛", "R, Rc¼", "R, Rc⅜" and so on (which are properly set according to JIS) corresponding to the "type and size of screw".

The symbol corresponding to the above-described condition is described on the sliding gauge (2). For example, the symbol "PUW" is located apart from the description "stainless" by the constant distance (D), respectively, are laterally arranged on the top of the base plate (3).

Similarly, symbols are described on the sliding gauge (2) such as: a symbol "F" corresponding to the "straight union" of the condition; a symbol "H" corresponding to the "male connector" of the condition; a symbol "P" corresponding to the "bulkhead union" of the condition; and a symbol "HP" corresponding to the "bulkhead male connector" of the condition.

Likewise, a corresponding symbols to the condition lists "nominal tube diameter" and "type and size of screw" are located apart from their corresponding symbols by the constant distance (D) on the sliding gauge (2), respectively.

A condition list desired by a user from the plurality of condition lists described above is set at the condition selecting windows laterally arranged of the base body (3). For example, as shown in FIG. 2, when the condition list "material" is set as one of the conditions "brass", the sliding gauge (2) is slid to display "brass" through the condition selecting window (7). At the same timer the symbol "PDW" corresponding to the condition list "brass" is displayed through the symbol selecting window (8).

The distance (D) between the condition selecting window (7) and the symbol selecting window (8), and the distance (D) between the desired condition and its corresponding symbol are equal so that the corresponding condition and the symbol are properly displayed from the condition selecting window (7) and the symbol selecting window (8).

A user may slide a sliding gauge (2) to expose conditions for condition items selected from conditions through the condition selecting window (7) laterally arranged on the base plate in a line, so that corresponding symbols are exposed through the symbol selecting windows (8), respectively. As shown in FIG. 2, lateral straight arrangement of the symbol selecting windows (8) from one edge to another edge of the base plate (3) results in a straight view for a joint part number desired by a user. In FIG. 2, the condition "material" is set as "stainless", "shape" is set as "straight union", "nominal tube diameter" is set as "1.6 mm" and "type and size of screw" is set as "R, Rc⅛". The symbols "PUW", "F"-"1.6", "A" corresponding to the above-described conditions respectively are selectively displayed.

That is, as shown in FIG. 4, a plurality of the symbols (B) indicates the joint part number (A).

According to the embodiment of the present invention, the desired part number can be linearly displayed at the symbol selecting windows laterally arranged on the base body (3) in a line by setting the desired condition at the condition selecting window (7) laterally arranged on the base body (3). Accordingly, the condition and the symbol can be quickly recognized with minimizing the possibility of misreading.

Note that the condition can also be selected after setting the symbol although the condition is set first to select the corresponding symbol in the present embodiment.

The sliding gauge (2) and the base body (3) in the present embodiment include a slide controlling means.

FIG. 5(*a*) shows a bottom of the sliding gauge, FIG. 5(*b*) shows a cross-sectional view of the sliding gauge and the base body, and FIG. 5(*c*) shows a sectional view showing a protrusion of the base body engaging with a concave of the sliding gauge.

That is, the sliding gauge (2) and the base body (3) in the present embodiment include the concave (13) and protrusion (14) such as: a semicircular tiny concave (13) on the bottom of the sliding gauge (2) as shown in FIG. 5(*a*), and a semicircular tiny protrusion (14) of the base body (3) on a lower inner surface contacting to the bottom of the sliding gauge (2) under the base body (3) as shown in FIG. 5(*b*). The semicircular tiny protrusion (14) engages with the tiny concave (13) provided on the bottom of the sliding gauge (2).

As shown in FIG. 5(*c*), the concave (13) of the sliding gauge (2) is formed at a boundary of the adjacent conditions and the adjacent symbols described on the surface of the sliding gauge (2). In the present embodiment, the concave of the sliding gauge (2) is formed at the boundary of the each of the conditions and each of the symbols described on the surface of the sliding gauge (2). However, the present invention is not limited to the above, and the concave of the sliding gauge (2) can be formed just under the each of the conditions and each of the symbols.

When the sliding gauge (2) is slid along with the base body (3), an appropriate friction can be produced between the sliding gauge (2) and the base body (3) by engaging the protrusion (14) of the base body (3) with the concave (13) on the bottom of the sliding gauge (2). Thus, the condition and the symbol on the sliding gauge (2) can be stopped at the condition selecting window (7) and the symbol selecting window (8) provided with the base body (3), respectively.

Thus, the sliding gauge (2) does not accidentally slide in the base body (3) by a small shock when the user read the desired condition and symbol, so that the desired condition and symbol can be read clearly.

The concave (13) is formed only in a half area of the sliding gauge (2) to the sliding direction, and the protrusion (14) is formed only in a half area of the base body (3) to the longitudinal direction.

The concave (13) and the protrusion (14) are not formed all over the sliding gauge (2) and the base body (3) to avoid too large friction between them to slide the sliding gauge (2) smoothly.

The above-described configuration can prevent the sliding gauge (2) from sliding too much and from sliding badly with respect to the base body (3).

Also, the sliding gauge (2) can be surely prevented from slipping out of the base body (3) by forming the concave (13) on the half area in a vicinity of the engagement part (6) of the sliding gauge (2) and the protrusion (14) on the half area in a vicinity of the inlet (9) of the base body (3).

Further, the sliding gauge can be easily stopped at the desired condition or symbol to expose the condition description area and the symbol description area on the tip of the sliding gauge through the condition selecting window and the symbol selecting window when the sliding gauge is almost maximally pulled by forming the concave (13) on the opposite half area of the engagement part (6) and the protrusion (14) on the opposite half area of the inlet (9) of the base body (3).

The present invention can be preferably used when accurately and quickly selecting the desired part number corresponding to the desired condition of the valve or joint.

What is claimed is:

1. A jig for selecting a valve part number or a joint part number represented by a combination of selected symbols representing respective selected conditions required for selecting a valve or a joint comprising:

a substantially rectangular base plate defining an inner space, and a plurality of linear sliding gauges laterally arranged in the inner space to slide in a longitudinal direction of the base plate, each of the sliding gauges comprising a condition description area including a plurality of conditions thereon from which the selected condition is determined, and a symbol description area including a plurality of symbols thereon, both the conditions and the symbols arranged in a sliding direction of the sliding gauge, a plurality of condition selecting windows laterally arranged on a top of the base plate, each condition selecting window configured to expose one of the selected conditions, a plurality of symbol selecting windows laterally arranged on the top of the base plate longitudinally apart from the condition selecting windows, respectively, each symbol selecting window configured to expose one of the selected symbols, wherein a distance between both windows is equivalent to a fixed distance between each of the symbols in the symbol description area and its corresponding condition in the condition description area.

2. The jig for selecting the part number of the valve or the joint in claim 1 further comprising a plurality of concaves on a bottom of the sliding gauge; and a plurality of protrusions on an inner surface of the base plate contacting to the bottom, the protrusion configured to engage with the concave, wherein a distance between the adjacent conditions and between the adjacent symbols described on the sliding gauge are equal to a distance between the adjacent concaves and between the adjacent protrusions.

3. The jig for selecting the part number of the valve or the joint in claim 2, wherein the concaves exist only in a longitudinal half area of the sliding gauge, and the protrusions exist only in a longitudinal half area of the base plate.

* * * * *